United States Patent [19]

Bodig et al.

[11] Patent Number: 5,075,627

[45] Date of Patent: Dec. 24, 1991

[54] CIRCUIT APPARATUS FOR MEASURING THE PRIMARY VOLTAGE OF AN IGNITION COIL

[75] Inventors: Bernd Bodig, Schwieberdingen; Achim Herzog, Schorndorf; Klaus Hueser, Stuttgart, all of Fed. Rep. of Germany

[73] Assignee: Robert Bosch GmbH, Stuttgart, Fed. Rep. of Germany

[21] Appl. No.: 490,360

[22] Filed: Mar. 8, 1990

[30] Foreign Application Priority Data

Mar. 9, 1989 [DE] Fed. Rep. of Germany ..... 3907616

[51] Int. Cl.[5] ..... F02P 17/00

[52] U.S. Cl. ..... 324/384; 324/388; 324/392

[58] Field of Search ..... 324/378, 390, 384, 388, 324/392; 73/116

[56] References Cited

U.S. PATENT DOCUMENTS

| | | | |
|---|---|---|---|
| 4,377,785 | 3/1983 | Ueno et al. | 324/390 X |
| 4,395,679 | 7/1983 | Gniewek et al. | 324/384 X |
| 4,399,407 | 8/1983 | Kling et al. | 324/384 X |
| 4,401,948 | 8/1983 | Miura et al. | 324/388 X |
| 4,918,389 | 4/1990 | Schleupen et al. | 324/388 X |

FOREIGN PATENT DOCUMENTS 3043255 7/1982 Fed. Rep. of Germany .

*Primary Examiner*—Kenneth A. Wieder

*Attorney, Agent, or Firm*—Frishauf, Holtz, Goodman & Woodward

[57] ABSTRACT

The voltage developed by a primary winding of an ignition coil is supplied to a voltage divider for furnishing an analog signal of reduced amplitude for evaluation on an analog basis, which reduced amplitude analog signal is averaged by a capacitor connected between the voltage divider tap and ground. The capacitor eliminates the undesired effect of voltage spikes, but is not large enough to interfere with the measurement of voltages exceeding the ignition-initiating primary winding voltage value. The same reduced primary winding voltage is supplied through an input resistor to one input of a differential amplifier connected to operate as a switch having hysteresis and having a reference voltage applied to it such that the output will be the provision of a steady voltage having a duration corresponding to the spark discharge duration, for subsequent digital evaluation. The tap of the voltage divider that provides the analog output voltage for the system is subjected to a clamping action provided by another voltage divider of low ohm value connected across a 5-volt source and having its tap connected to the tap of the first mentioned voltage divider by a diode, so that primary winding voltages above the spark-initiating voltage will be measured on a reduced scale, while the differential amplifier and other integrated circuits are prevented from having overvoltages applied to them. The circuit is therefore suited for economical manufacture in so-called hybrid technology.

19 Claims, 2 Drawing Sheets

CIRCUIT APPARATUS FOR MEASURING THE PRIMARY VOLTAGE OF AN IGNITION COIL

The invention concerns the measurement of the primary voltage of an ignition coil after a path for current in the primary winding of the coil has been interrupted to generate an ignition pulse for an internal combustion engine.

The interruption of an exciting current in the ignition coil creates a voltage rise that is magnified by the secondary winding for production of an ignition spark in the engine. Although the primary voltage wave subsides and trails off soon, the secondary circuit of the ignition coil keeps the spark action continuing for an interval that, in a particular case, depends upon the magnitude of the primary voltage wave. Circuits have accordingly become known for measuring the primary voltage of ignition coils in motor vehicles. These known circuits require transistors and zener diodes for measuring the spark duration interval. At the output of such known circuits a digital signal is usually prepared that designates the spark discharge duration. The necessary transistors and zener diodes are unsuitable for use in so-called hybrid circuits, since these components involve relatively high manufacturing expense. Hybrid circuits, which contain at least one intergrated circuit (IC) unit, but also contain some discrete components operating under conditions unsuitable for most ICs, are well suited for the automotive environment where some components need to function under the latter type of conditions.

SUMMARY OF THE INVENTION

It is an object of the present invention to provide not only a measurement of spark discharge duration, but also a more direct measurement of primary voltage by means of a circuit that does not require zener diodes or discrete transistor and, therefore, can be economically manufactured.

Briefly, the primary voltage is supplied through a protective diode, in its direction of easy conduction, to a voltage divider from the tap of which a connection is made through an input resistance to one input of a differential amplifier, to the other input of which a reference voltage is supplied for producing in the differential amplifier operating as a switching comparator with hysteresis, a signal from which the spark discharge duration can be determined, while the voltage appearing at the tap of the voltage divider is supplied directly to an analog evaluation circuit to provide a measurement of the primary voltage. Preferably the voltage thus directly connected to the analog evaluation circuit is modified by the averaging effect of a capacitor in parallel with the grounded resistor of the voltage divider.

The circuit apparatus of the invention has the advantage that the spark discharge duration can be digitally evaluated, while at the same time here is an opportunity to measure the primary voltage in analog fashion on two different scales. When a motor vehicle is equipped with so-called quiescent ignition voltage distribution and therefore has two or more ignition coils, all of the ignition coils can be monitored with the same circuit apparatus of the invention for their respective primary voltages. For this purpose, at the input of the circuit of the invention, a number of input diodes operating in their direction of conduction can be used, with the effect of an input OR gate through which the respective primary waves of the respective ignition coils can sequentially enter the circuit apparatus of the invention.

The analog primary voltage is thus first reduced by a fixed factor and then the resulting reduced primary voltage is evaluated both in an analog and in a digital fashion. It is thus possible to provide an analog ignition voltage determination as well as a digital spark dicharge duration determination.

No discrete transistors and zener diodes are necessary, so that circuit apparatus implementation in so-called hybrid technology is readily and economically obtainable.

In order to avoid errors or distortions as a result of voltage peaks or spikes, an averaging capacitor is connected from the voltage divider tap to the low voltage end of the voltage divider, i.e. to so-called chassis ground. By means of a protective clamp circuit, moreover, following intergrated circuit unit inputs can be protected against overvoltage. The evaluation circuits respectively connected to the voltage divider tap and to the output of the differential amplifier of the circuit apparatus of the invention would expectably be incorporated in the microcomputer of an existing or future type of motor control equipment, and there connected for participation in monitoring and/or control functions of the motor control equipment.

BRIEF DESCRIPTION OF THE DRAWINGS

The invention is further described for more complete explanation by way of illustrative example, with reference to the annexed drawings, in which.

DESCRIPTION OF THE ILLUSTRATED EMBODIMENT

Figure 1:
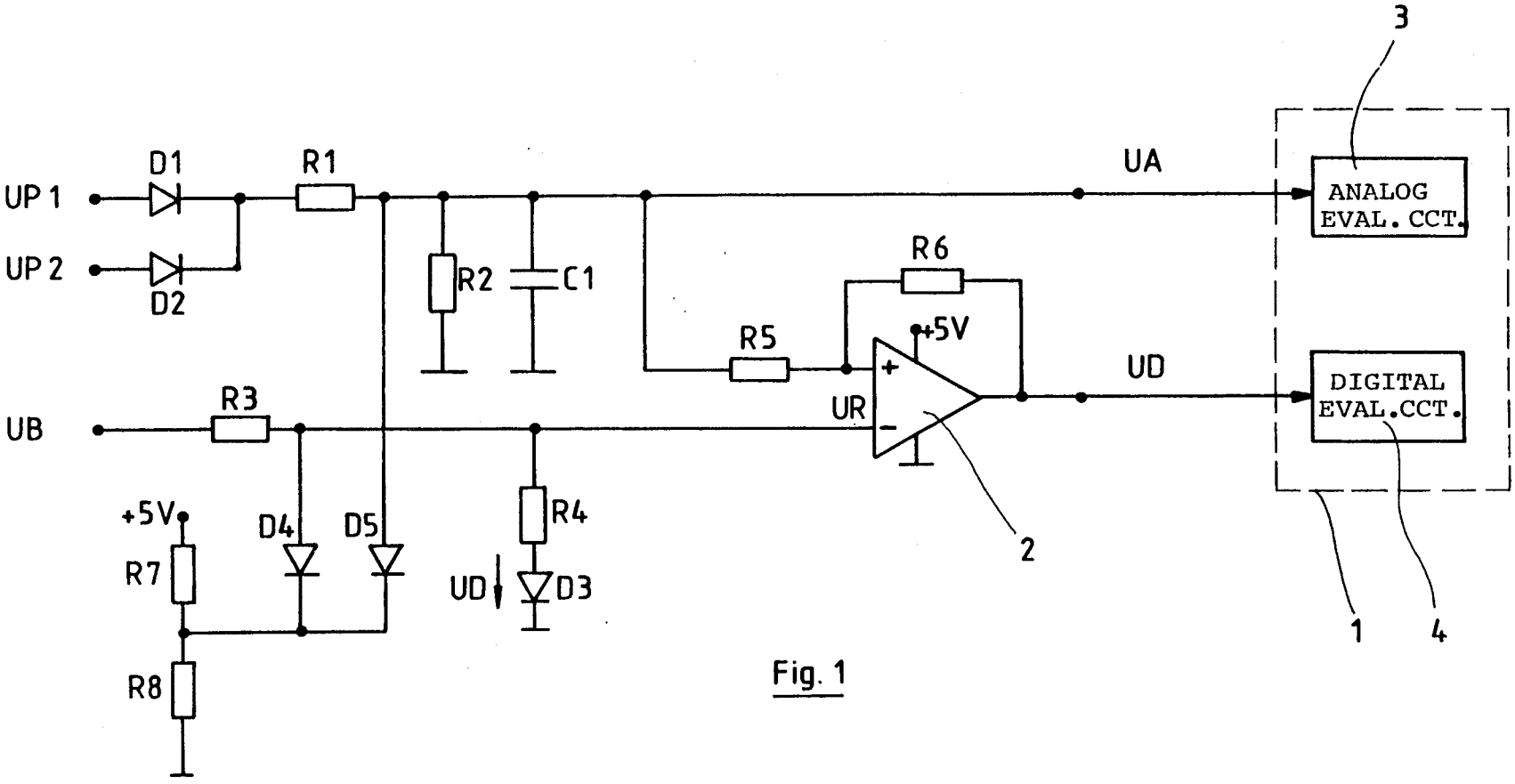
FIG. 1 is a circuit diagram of a circuit apparatus of the invention for providing analog and digital ignition coil primary voltage determination.

The circuit apparatus shown in FIG. 1 has two inputs for respective primary voltage UP1 and UP2 provided in respective primary windings of two ignition coils (not shown) of a so-called quiescent ignition voltage distributor system utilizing those two unshown ignition coils. The circuit of the invention operates in the same fashion whether there is a single ignition coil or whether there are two or more of them. FIG. 1 illustrates how the primary voltage connected from an appropriate connection to the ignition coil in each case is connected through a separate protective diode D1 or D2, to the voltage divider R1, R2 which produces the voltage UA that is supplied to the analog evaluation circuit 3.

The protective diodes D1, D2 together constitute an OR gate. The voltage divider, composed of the resistances R1 and R2, reduces the voltage appearing at the common connection of the two diodes D1 and D2 by the factor $R2/(R1+R2)$ to produce the voltage UA. In order to prevent erratic results that may be produced by voltage spikes, a capacitor C1 is connected across the voltage divider resistance R2 to provide an averaging or integration of the reduced primary voltage with a time constant suitable for integrating the wave shown in FIG. 2 for UP to produce the UA wave shown in FIG. 3.

The reduced primary voltage, as thus integrated, provides the analog output voltage UA to an evaluation circuit 1 of a conventional kind that must of course be selected for compatibility with a monitoring and control system that may be installed in the motor vehicle. Such an evaluation circuit would normally provide a response at one or more threshold voltages dependent upon the characteristics of the particular ignition system installed in the motor vehicle.

The battery voltage UB of the storage battery of the motor vehicle is supplied to a second voltage divider composed of the resistances R3 and R4. This second voltage divider has a tap connected to the inverting input of the differential amplifier 2, where it supplies the reference voltage UR. For reasons of symmetry the resistances of the first and second voltage dividers have the following relations: R1=R3 and R2=R4. For shifting of the switching threshold of the differential amplifier 2 a diode D3, which develops the forward voltage drop UD of the diode, is inserted between the voltage divider resistance R4 and ground.

The voltage-divided primary voltage UA is connected from the tap of the first voltage divider R1, R2 through an input resistance R5 to the non-inverting input of the differential amplifier 2. A feedback resistance R6 is connected between the output of the non-inverting input of the differential amplifier 2, so that the latter will operate as a comparator with switching hysteresis to produce a digital output voltage UD having a duration corresponding to the duration of the spark discharge produced in response to the primary voltage wave. The digital output voltage UD is then supplied to an evaluation circuit 4, which may simply be a counter starting from a reset condition at the beginning of the signal voltage UD and stopped, and then read out, at the end of the signal voltage UD. The rate of counting of course depends upon the characteristic of the particular ignition system, and so would the use that is made of the resulting digital signal.

In order to protect the inputs of integrated circuits that may follow (including the differential amplifier 2 which is energized by a 5-voltage source as shown in FIG. 1) the primary voltage produced at the tap of the voltage divider R1, R2 is clamped by means of a third voltage divider of low ohm value consisting of the resistances R7 and R8 to the tap of which it is connected by the diode D5. This third voltage divider is connected between the previously mentioned 5-volt source and ground. The 5-volt source is usually rather well regulated. The clamping effect is so dimensioned that the primary voltages above the voltage necessary for spark discharge are subject to clamping action, at which time (i.e. for these voltages) the voltage divider resistance R1 and R7 are in effect in parallel to R8. Voltages above the voltage necessary for spark discharge can thus be measured, still an analog fashion, on a modified scale in the evaluation circuit 1. The capacitor C1 must be chosen to be small enough for the analog evaluation of overvoltages, as will be more evident in connection with the description given below of FIG. 3.

The diode D4 has the same function, with reference to the battery voltage UB, as the diode D5 has with reference to the primary voltage UP1 or UP2.

The differential amplifier 2 is connected as a comparator and compares the divided primary voltage UA with the reference voltage UR which has been derived by means of a voltage divider from the battery voltage UB. The comparator has an amount of hysteresis which is determined by the values of the resistances R5 and R6 in a known way does not need to be described here.

In the evaluation circuit 1 that can be part of a motor control system not shown in the drawing or described here, an analog primary voltage determination circuit 3 is provided and also a digital spark duration determination circuit 4. The values thus obtained can be taken account of in the control operations of an electronic motor control system of any of a variety of known types, as will be recognized by a person skilled in the art. The output voltage UA and the output voltage corresponding to the duration of the signal UD can also be evaluated for recognition of malfunctions of the ignition system or of the motor.

Figures 2, 3, 4:
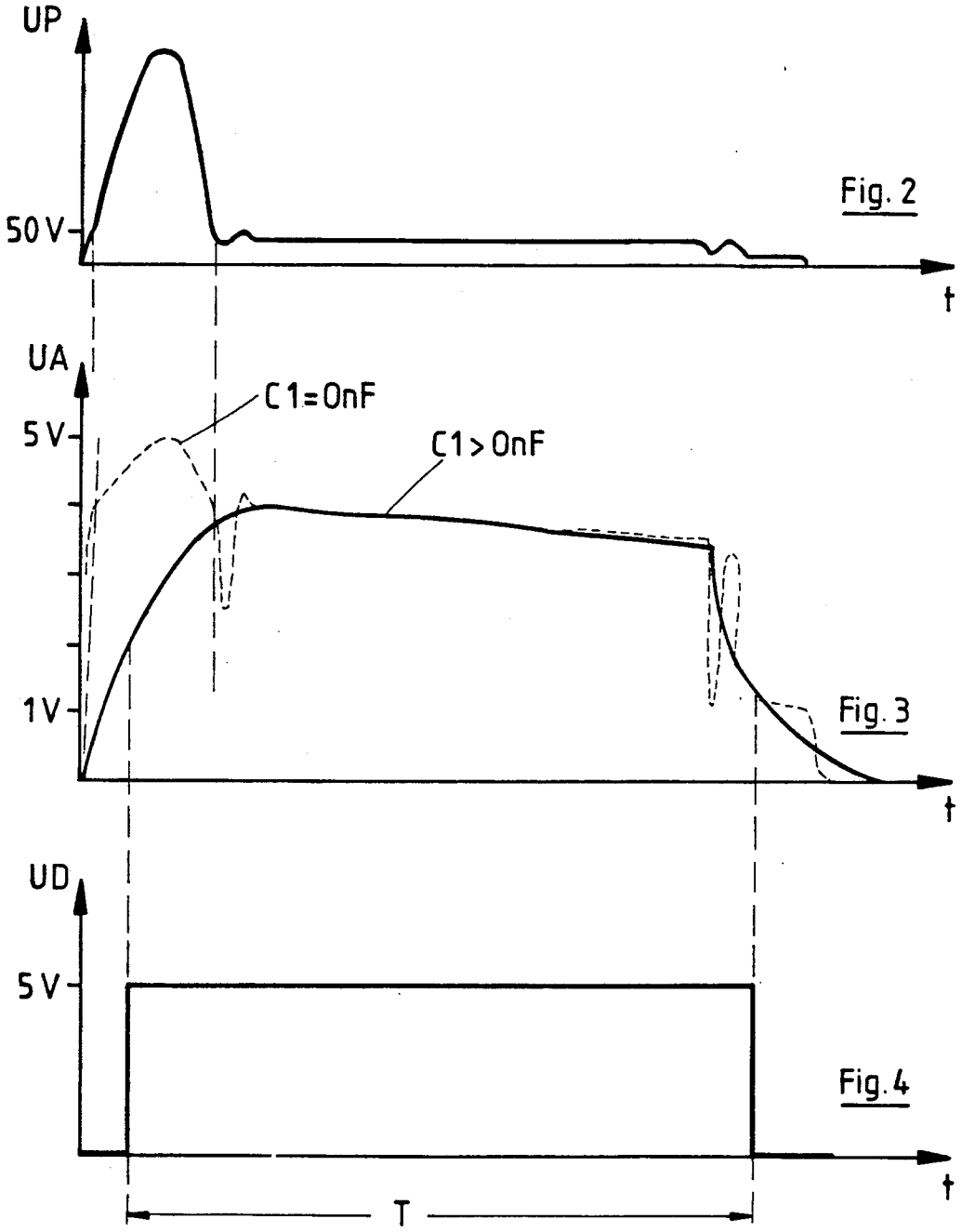
FIG. 2 is a graph of the course of the primary voltage produced by an ignition coil in response to current path interruption in its primary winding circuit.
FIG. 3 is a graph on the same time scale as FIG. 2 showing the course of the output voltage for analog evaluation provided by the circuit of FIG. 1.
FIG. 4 is a graph on the same time scale as FIG. 2 showing the output of the differential amplifier which supplies an output signal for digital evaluation.

FIG. 2 shows the time course of a primary voltage UP, which may be the voltage UP1 or the UP2 in the case of FIG. 1. The corresponding output voltage UA and UD are shown respectively in FIG. 3 and in FIG. 4. The broken lines shown in FIG. 3 represent the analog output voltage UA in the absence of the presence of a capacitor C1. For this situation the capacitor C1 can be regarded as having the capacitance 0 expressed in nF units. The presence of the capacitor C1 in the circuit of FIG. 1 results in the solid line voltage course which shows the value of the voltage UA and what it would be in the absence of that capacitor. In this case the value of the capacitance C1 and those of the resistors to which it is connected are such that the resulting time constant has a magnitude not differing greatly from the length of the pulse portion of the voltage wave shown in FIG. 2. The value of the resistances of the voltage divider R1, R2 are small enough so that in the absence of the capacitor C1 the value of UA shown in FIG. 3 will drop and follow the trailing edge of the initial pulse shown in FIG. 2. The broken line shows, during the presence of the initial pulse, the clamping action of the third voltage divider that sets in at four volts. When the capacitor C1 is present, the rise time of $U_A$ is extended and, as shown in FIG. 4, the beginning of the signal voltage UD is correspondingly delayed by a small amount, which can be adjusted for, in the setting of the switch-on threshold, by the choice of the diode D3.

FIG. 4 shows the signal of voltage UD, which has a duration corresponding to the spark discharge time. If the switching threshold is appropriately set by the diode D3, the onset of the UD signal, shown in FIG. 4 by the broken vertical line, would show the range of primary voltage to the ignition point and where the so-called overvoltage begins. In this case, the slope of the curve rise in FIG. 3 above the ignition point is not much less and that below the ignition point until a voltage far above the ignition point is reached, so that a considerable range of so-called overvoltage can be measured on a somewhat reduced scale.

This may be but does not have to be in place that the clamping action of the third voltage divider sets in. In any event, the presence of the capacitor C1 meets the transistion from no clamping action from clamping action much less visible as noted in connection with FIG. 3. The smaller slope of the ice curve after the clamping action sets in represents a change of scale above a certain threshold chosen for overvoltage measurement.

A table is given below showing an illustrative set of suitable values for the various resistors and an illustrative suitable value of a capacitor C1 for an ignition coil primary voltage measuring system of the kind shown in FIG. 1.

| Ref. Symbol | Ohms value | Ref. Symbol | Value |
|---|---|---|---|
| R1, R3 | 100 kΩ | C1 | 33 nF |
| R2, R4 | 5 kΩ | | |
| R5 | 40 kΩ | | |
| R6 | 600 kΩ | | |
| R7 | 250 Ω | | |
| R8 | 750 Ω | | |

Although the invention has been described with reference to a particular illustrative example, and a set of particular component values has been given by way of example only, it will be readily understood that a considerable range of variations and modifications are possible within the inventive concept.

We claim:

1. Circuit apparatus for evaluating voltage produced in the primary winding of an ignition coil of an internal combustion engine after interruption of a path of current therethrough, said apparatus comprising:

means for comparing voltage present across said primary winding or a fraction thereof with a reference voltage, said comparing means including a comparing element (2) of a kind which provides a change from a normal output logic level to a modified logic level so long as said voltage being compared with said reference voltage, as augmented or diminished by hysteresis-producing circuit elements if said elements are present in said comparing means, exceeds said reference voltage;

means (4) responsive to the output of said comparing means for producing a digital signal representative of the duration of said modified logic level at an output of said comparing means, and evaluation circuit means (3), responsive to said voltage which is compared to said reference voltage, for producing an analog electrical signal representative of the value of an ignition voltage in said engine.

2. The circuit apparatus of claim 1, wherein said comparing means is a means for comparing a fraction of said voltage across said primary winding with said reference voltage, wherein a first voltage divider (R1, R2) is provided for obtaining at a tap connection thereof said fraction of said voltage across said primary winding, and wherein said voltage divider includes means for providing a degree of averaging of said fraction of said voltage across said primary winding for avoiding disturbance, by voltage spike formation in said primary winding, of the analog electrical signal produced by said evaluation circuit means.

3. The circuit apparatus of claim 3, wherein said means for averaging said voltage fraction is a capacitor (C1) connected to said tap connection of said voltage divider.

4. The circuit apparatus of claim 1, wherein voltage clamping means are provided for imposing a predetermined maximum limit for said voltage which is compared with said reference voltage, said clamping means including a clamp diode (D5) and a voltage divider (R7, R8) supplied with a substantially constant voltage and having a tap connection to which said diode is connected, said diode being connected between said tap and a source of said voltage present across said primary winding or a fraction thereof which is compared with said reference voltage.

5. The circuit apparatus of claim 2, wherein voltage clamping means are provided for imposing a predetermined maximum limit for said voltage which is compared with said reference voltage, said clamping means including a clamp diode (D5) and a second voltage divider (R7, R8) supplied with a substantially constant voltage and having a tap connection to which said diode is connected, said diode being connected between said tap and said tap connection of said first voltage divider.

6. The circuit apparatus of claim 3, wherein voltage clamping means are provided for limiting to a predetermined maximum limit said voltage which is compared with said reference voltage, said clamping means including a clamp diode (D5) and a second voltage divider (R7, R8) supplied with a substantially constant voltage and having a tap connection to which said diode is connected, said diode being connected between said tap and said tap connection of said first voltage divider.

7. The circuit apparatus of claim 1, wherein said comparing means comprises a differential amplifier having two inputs and an output and connected as a switch having hysteresis by virtue of an input resistance (R5) connected in series with its input to which is connected said voltage which is compared with said reference voltage and a feedback resistance (R6) connected between the output of said differential amplifier and said input thereof to which said input resistance is connected.

8. The circuit apparatus of claim 2, wherein said comparing means comprises a differential amplifier having two inputs and an output and connected as a switch having hysteresis by virtue of an input resistance (R5) connected in series with its input to which is connected said voltage which is compared with said reference voltage and a feedback resistance (R6) connected between the output of said differential amplifier and said input thereof to which said input resistance is connected.

9. The circuit apparatus of claim 3, wherein said comparing means comprises a differential amplifier having two inputs and an output and connected as a switch having hysteresis by virtue of an input resistance (R5) connected in series with its input to which is connected said voltage which is compared with said reference voltage and a feedback resistance (R6) connected between the output of said differential amplifier and said input thereof to which said input resistance is connected.

10. The circuit apparatus of claim 1, wherein said means providing averaging includes a capacitor connected to at least one resistor.

11. The circuit apparatus of claim 1, wherein said internal combustion engine has a plurality of ignition coils each of which has a primary winding and wherein each of said primary windings is connected through a protective diode to said comparing means, said protective diodes connected respectively to said primary windings constituting an OR-gate.

12. The circuit apparatus of claim 2, wherein said internal combustion engine has a plurality of ignition coils each of which has a primary winding and wherein each of said primary windings is connected through a protective diode to said comparing means, said protective diodes connected respectively to said primary windings constituting an OR-gate.

13. The circuit apparatus of claim 3, wherein said internal combustion engine has a plurality of ignition coils each of which has a primary winding and wherein each of said primary windings is connected through a protective diode to said comparing means, said protective diodes connected respectively to said primary windings constituting an OR-gate.

14. The circuit apparatus of claim 4, wherein said internal combustion engine has a plurality of ignition coils each of which has a primary winding and wherein each of said primary windings is connected through a protective diode to said comparing means, said protective diodes connected respectively to said primary windings constituting an OR-gate.

15. The circuit apparatus of claim 5, wherein said internal combustion engine has a plurality of ignition coils each of which has a primary winding and wherein each of said primary windings is connected through a protective diode to said comparing means, said protective diodes connected respectively to said primary windings constituting an OR-gate.

16. The circuit apparatus of claim 6, wherein said internal combustion engine has a plurality of ignition coils each of which has a primary winding and wherein each of said primary windings is connected through a protective diode to said comparing means, said protective diodes connected respectively to said primary windings constituting an OR-gate.

17. The circuit apparatus of claim 7, wherein said internal combustion engine has a plurality of ignition coils each of which has a primary winding and wherein each of said primary windings is connected through a protective diode to said comparing means, said protective diodes connected respectively to said primary windings constituting an OR-gate.

18. The circuit apparatus of claim 8, wherein said internal combustion engine has a plurality of ignition coils each of which has a primary winding and wherein each of said primary windings is connected through a protective diode to said comparing means, said protective diodes connected respectively to said primary windings constituting an OR-gate.

19. The circuit apparatus of claim 9, wherein said internal combustion engine has a plurality of ignition coils each of which has a primary winding and wherein each of said primary windings is connected through a protective diode to said comparing means, said protective diodes connected respectively to said primary windings constituting an OR-gate.

* * * * *